US005865075A

United States Patent [19]

Medved

[11] Patent Number: 5,865,075

[45] Date of Patent: Feb. 2, 1999

[54] CONVERTIBLE PLIER TOOL

[75] Inventor: Gary E. Medved, Lyndhurst, Ohio

[73] Assignee: Stride Tool Inc., Ellicottville, N.Y.

[21] Appl. No.: 749,620

[22] Filed: Nov. 18, 1996

[51] Int. Cl.[6] ..... B25B 7/12

[52] U.S. Cl. ..... 81/302; 81/385; 81/394; 29/229

[58] Field of Search ..... 81/302, 342, 385, 81/394, 405, 406, 415, 416; 29/229, 225

[56] References Cited

U.S. PATENT DOCUMENTS

| | | | |
|---|---|---|---|
| 252,248 | 1/1882 | Pease | 81/394 |
| 3,762,019 | 10/1973 | Epstein | 81/394 |
| 4,280,265 | 7/1981 | Murphy . | |
| 4,296,655 | 10/1981 | Tesoro | 81/405 |
| 4,476,750 | 10/1984 | Murphy . | |
| 4,793,224 | 12/1988 | Huang | 81/385 |
| 5,515,587 | 5/1996 | Pool | 81/416 |

FOREIGN PATENT DOCUMENTS

| | | | |
|---|---|---|---|
| 1064990 | 7/1954 | France | 81/394 |
| 2364509 | 6/1995 | Germany | 29/229 |
| 1334877 | 10/1973 | United Kingdom | 81/394 |

*Primary Examiner*—David Scherbel
*Assistant Examiner*—Joni B. Danganan
*Attorney, Agent, or Firm*—Hodgson, Russ, Andrews, Woods & Goodvear LLP

[57] ABSTRACT

A plier tool which is convertible between a type wherein the jaws spread apart when the handles are squeezed and a type wherein the jaws close when the handles are squeezed. A pair of apertures, one for each type, is provided in one of the plier levers. The pivot assembly is insertable in and removable from each of the apertures for making the conversion.

10 Claims, 7 Drawing Sheets

CONVERTIBLE PLIER TOOL

The present invention relates generally to tools such as pliers. Examples of pliers are found in U.S. Pat. Nos. 4,280,265 and 4,476,750.

It is an object of the present invention to convert a plier tool between a type wherein the jaws open or spread apart when the handles are squeezed (moved toward each other) and a type wherein the jaws close or come together when the handles are squeezed.

It is another object of the present invention to provide such convertibility so that parts are not lost as the tool is being so converted.

It is a further object of the present invention to provide such a plier tool which is easily converted to a desired type yet remains so converted during use of the tool.

In accordance with the present invention, such convertibility is provided by an aperture for each plier tool type in one of the levers, and the pivot assembly, which is received in an aperture in the other lever, is removably and selectively receivable in one of the apertures in the one lever for the desired type plier tool.

The above and other objects, features, and advantages of the present invention will be apparent in the following detailed description of the preferred embodiment thereof, when read in conjunction with the accompanying drawings wherein the same reference numerals denote the same or similar parts throughout the several views.

DETAILED DESCRIPTION OF THE PREFERRED EMBODIMENT

Figure 1:
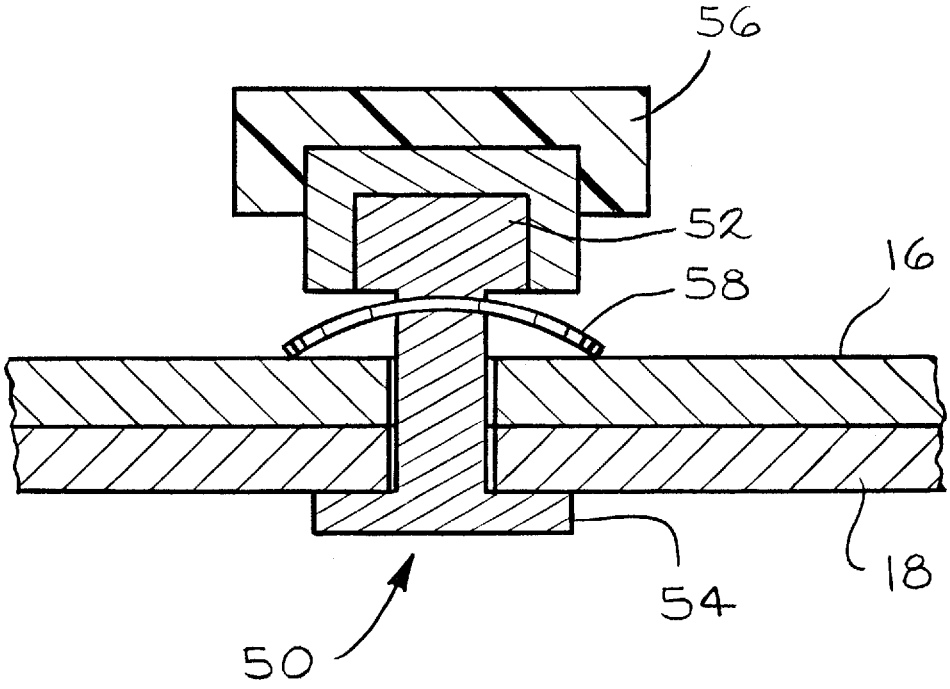
FIG. 1 is a partial, schematic, sectional view illustrating pliers in accordance with the present invention.
Figure 2:
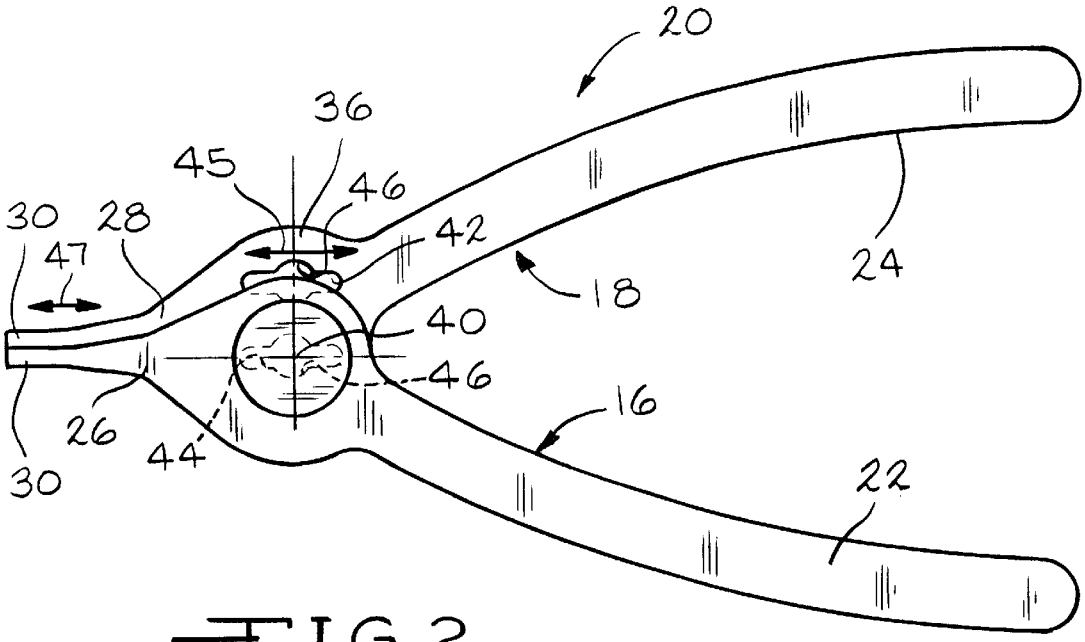
FIG. 2 is a plan view of pliers which embodies the present invention.
Figure 3:
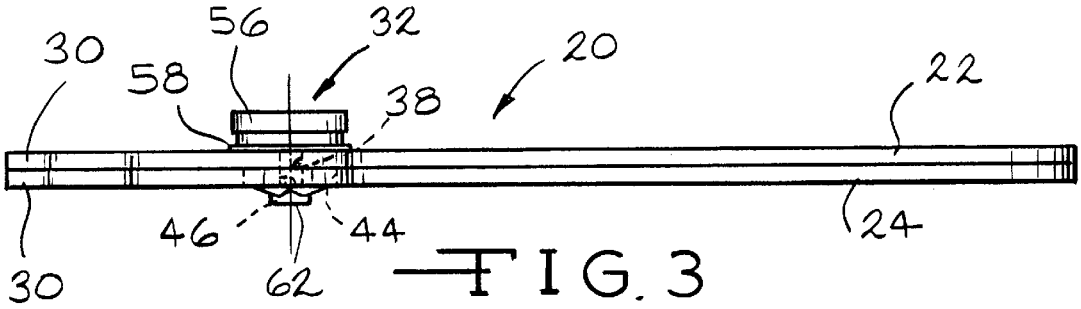
FIG. 3 is a side view thereof.
Figure 9:
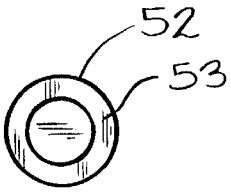
FIGS. 8 and 9 are side and top views respectively of a T-nut therefor.
Figure 8:
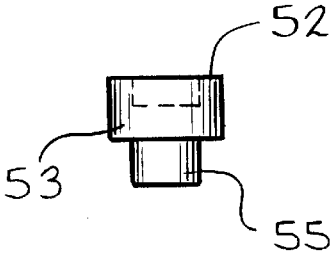
Figure 4:
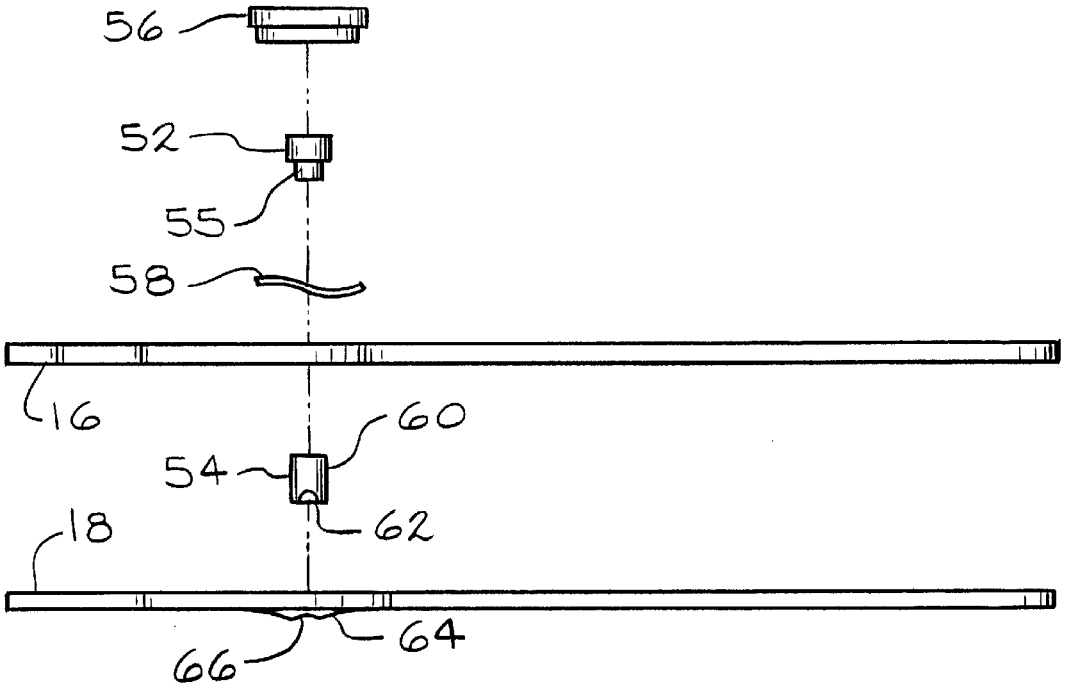
FIG. 4 is an exploded view thereof.
Figure 6:
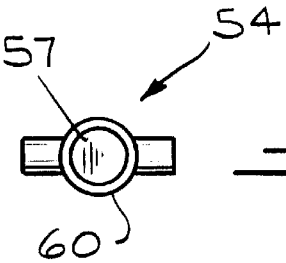
FIGS. 5, 6, and 7 are front, top, and side views respectively of a T-bolt therefor.
Figure 5:
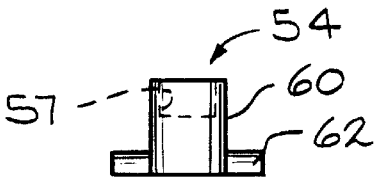
Figure 7:
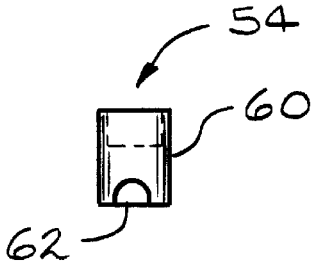
Figure 10:
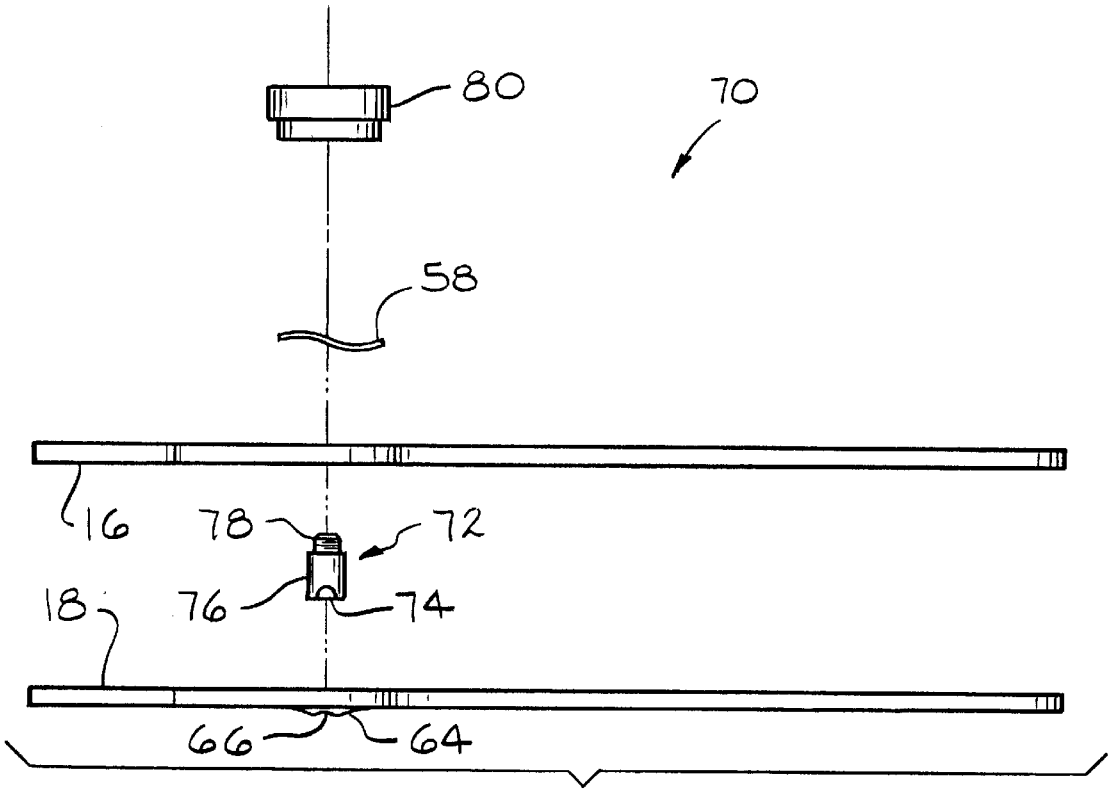
FIG. 10 is an exploded view of pliers in accordance with an alternative embodiment of the present invention, the plan and side views thereof being the same as FIGS. 2 and 3 respectively.
Figure 12:
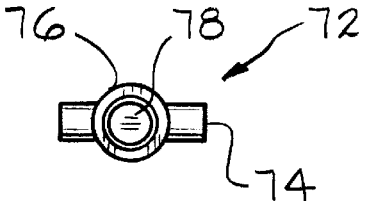
FIGS. 11, 12, and 13 are front, top, and side views respectively of a T-bolt for the pliers of FIG. 10.
Figure 11:
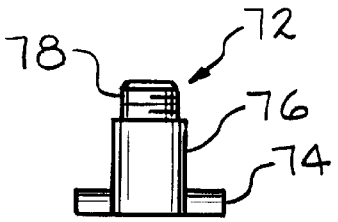
Figure 13:
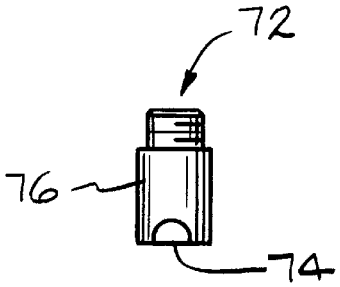
Figure 14:
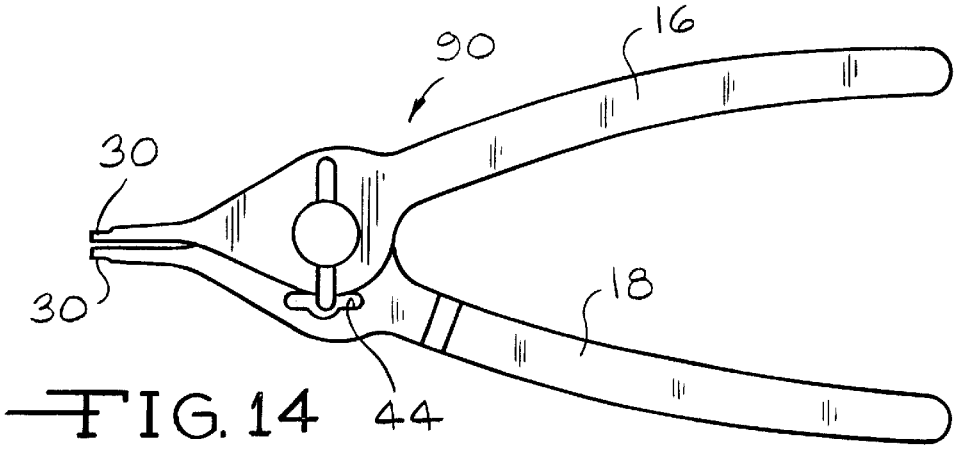
FIG. 14 is a view similar to that of FIG. 2 of another embodiment of the plier tool of the present invention, showing the plier tool converted to one type.
Figure 15:
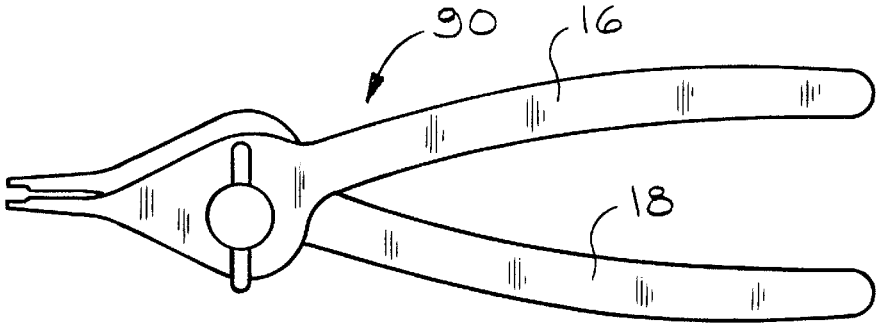
FIG. 15 is a view similar to that of FIG. 2 of the embodiment of FIG. 14, showing the plier tool converted to the other type.

Referring to FIGS. 1 to 9, there is shown generally at 20 a plier tool which may be called a pair of pliers comprising planar levers 16 and 18. The levers include top or left-hand handle 22 and bottom or right-hand handle 24 respectively having jaws 26 and 28 respectively which terminate in retaining ring tips 30, which may be straight, as shown, or formed so as to be oriented at 90 or 45 degrees or another suitable angle relative to the planes of the levers. However, plier tools having other uses are also meant to come within the scope of the present invention. The plier tool 20 has a pivot assembly, illustrated generally at 32, contained within enlarged portions 34 and 36 of the levers 16 and 18 respectively and defining the handles and the jaws on opposite sides thereof. The center of an aperture, illustrated at 38, through the enlarged portion 34 of the top lever 16 defines the pivot center-point, illustrated at 40.

Figure 16:
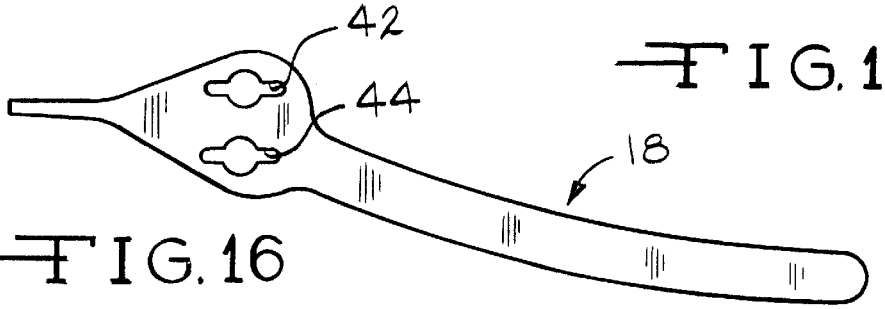
FIG. 16 is a view similar to that of FIG. 2 of one of the levers of the plier tool of FIG. 14.
Figure 17:
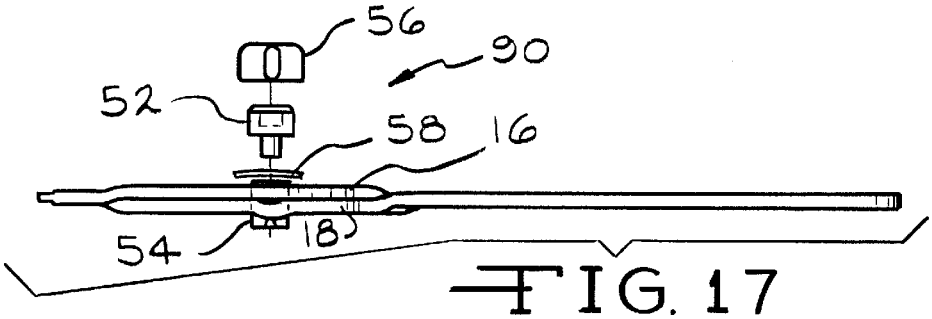
FIG. 17 is a side view, partially exploded, of the plier tool of FIG. 14.
Figure 18:
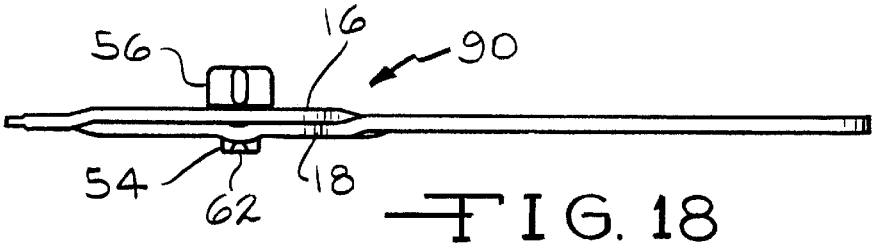
FIG. 18 is a view similar to that of FIG. 3 of the plier tool of FIG. 14.
Figure 25:
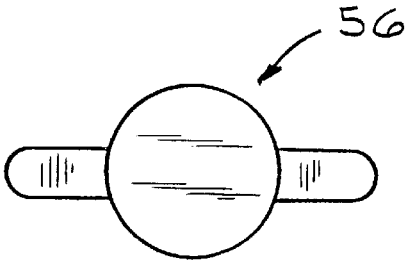
FIGS. 24 and 25 are side and top views respectively of a knob for the plier tool of FIG. 14.
Figure 24:
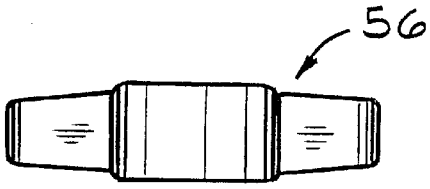
Figure 26:
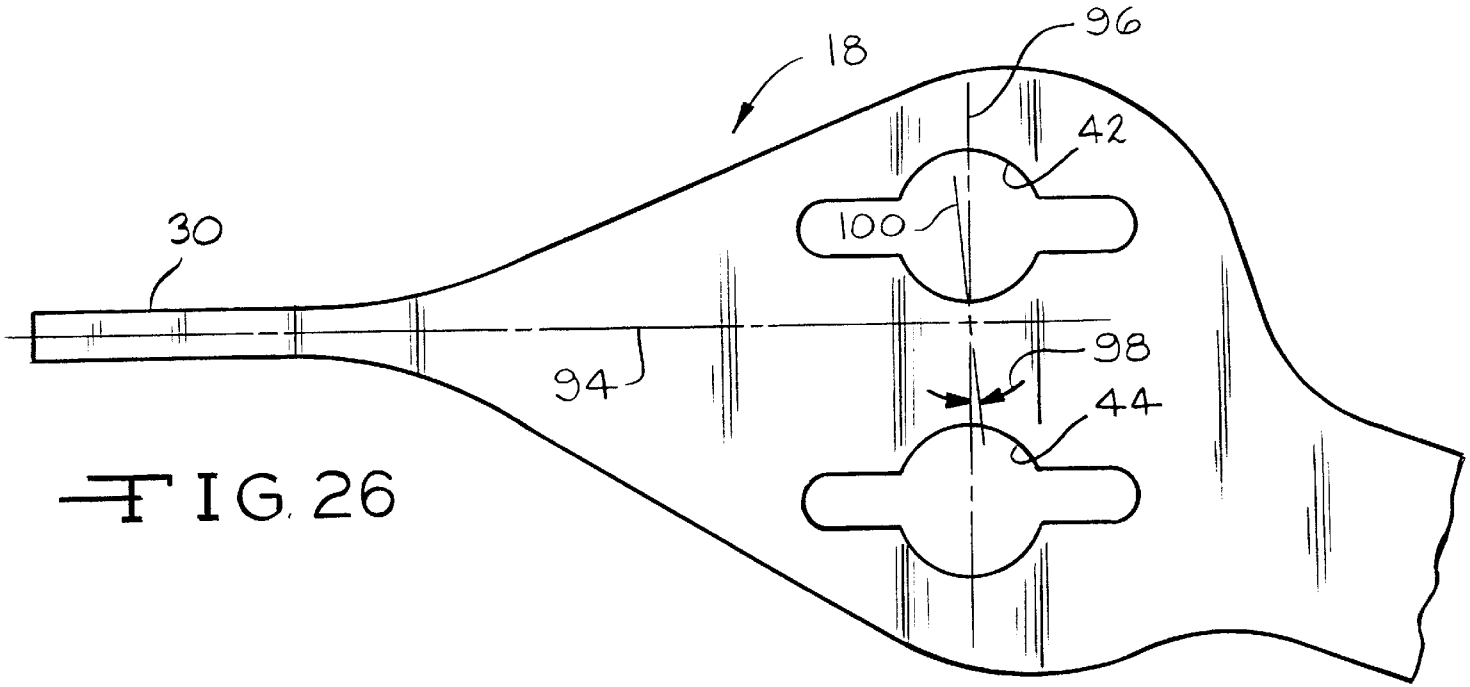
FIG. 26 is an enlarged partial plan view of the lever of FIG. 16.

The bottom lever 18 has a pair of spaced cross-sectionally elongate apertures 42 and 44 passing through the enlarged portion 36 thereof, as best seen in FIGS. 16 and 26, i.e., the aperture shape is uniform over the lever thickness and is shaped to be elongate (having a length greater than the width) as viewed in a plane parallel to the upper surface of the lever 18, and the lengthwise direction thereof, illustrated at 45, is parallel to the direction, illustrated at 47, in which the tip 30 of lever 18 extends. Each of the elongate apertures 42 and 44 is alignable with aperture 38 to receive the pivot assembly 32 to provide convertibility to the pliers. Thus, with the pivot assembly received in elongate aperture 44 and the handles 22 and 24 in the position shown in FIG. 2, the tips 30 spread apart when the handles are squeezed. But with the pivot assembly received in elongate aperture 42 and the handles 22 and 24 in the position shown in FIG. 2, the tips come together or close when the handles are squeezed. Thus, the plier tool 20 is convertible between an internal and an external tool.

The elongate apertures 42 and 44 have cross-sectionally enlarged central circular portions 46 the centers of which are alignable with the center-point 40 for receiving the pivot assembly 32.

The pivot assembly 32 includes a bushing 50 formed by a T-bolt 54 and a screwhead 52 suitably joined together, a plastic knob 56 which is press-fit on the screwhead 52, and a Belleville or Curver or other suitable spring washer 58, which overlies the top lever 16. The screwhead 52 has a head portion 53 and further has a reduced diameter portion 55 which is received in a bore 57 in the upper end of the shank portion 60 of the T-bolt 54 for joining the T-bolt to the screwhead 52. The shank 60 of the T-bolt 54 passes through the aperture portion 46 in the lever 18 and the aperture 38 in the lever 16 and then through the spring washer 58. The T-bolt 54 has an elongate portion 62 which is on the lower end of the shank 60 and which extends radially outwardly from the shank 60 on opposite sides thereof. Thus, the levers 16 and 18 and the spring washer 58 are sandwiched between the elongate portion 62 and the head portion 53. The elongate portion 62 is sized to have a length so that it cannot pass through the respective elongate aperture 42 or 44 when it is disposed cross-wise thereto. However, this portion 62 is also sized so that, when turned ¼ turn or 90 degrees from this cross-wise position, it may pass through the respective elongate aperture 42 or 44 but still cannot pass through aperture 38. Thus, the pivot assembly 32 is detachable from the bottom lever 18 so that it may be inserted in the other elongate aperture for convertibility of the pliers but remains attached to the top lever 16 so that parts of the pivot assembly are not lost during conversion from one type of plier to the other.

The bottom lever 18 has a pair of formations 64 (only one shown) on its lower surface and through which the elongate apertures 42 and 44 respectively pass. Each of the formations 64 is of a cam lock style, i.e., it has a raised ramp with a locking groove 66 in its lower surface which is oriented in a direction cross-wise to the lengthwise direction 45 of the respective elongate aperture and is suitably sized to receive the elongate portion 62 so that it does not slip out of its cross-wise orientation during normal use of the pliers.

The shank portion 60 has a length such that the elongate portion 62 is normally firmly or tightly held in the groove 66 by the spring washer 58 for use of the pliers, the spring washer 58 being biased to urge the elongate portion 62 against the bottom lever 18. When it is desired to convert the pliers, the elongate portion 62 is urged over the ramp 64, thereby compressing the spring washer 58, while turning the elongate portion ¼ turn or 90 degrees so that it extends in the direction illustrated at 45 so that it may pass through the elongate aperture. This results in the top lever 16 with the pivot assembly attached becoming detached from the bottom lever 18. The elongate member 62 may then be inserted through the other elongate aperture and the elongate portion 62 urged over the ramp 64 therefor, thereby again compressing the spring washer 58, while turning the elongate portion ¼ turn or 90 degrees so that it may be lockingly received in the respective groove 66, thereby converting the pliers with the spring washer 58 firmly holding the elongate member 62 in the respective groove 66.

Referring to FIGS. 10 to 13, there is illustrated at 70 an alternative embodiment of the pliers wherein the pivot assembly includes a T-bolt 72 having on one end of its shank 76 an elongate member 74, similar to elongate member 62, and on the other end thereof a threaded portion 78 for threadedly receiving a knob 80. The pliers 70 are otherwise similar and are usable similarly to pliers 20.

Figure 23:
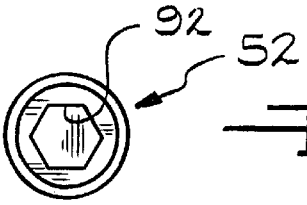
FIGS. 22 and 23 are side and top views respectively of a screwhead for the plier tool of FIG. 14.
Figure 22:
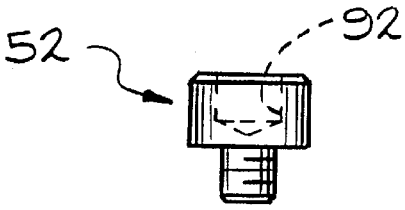
Figure 20:
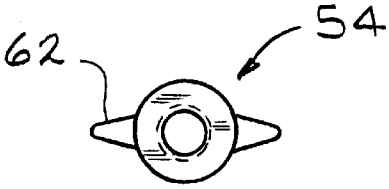
FIGS. 19, 20, and 21 are views similar to those of FIGS. 5, 6, and 7 respectively of a T-bolt for the plier tool of FIG. 14.
Figure 19:
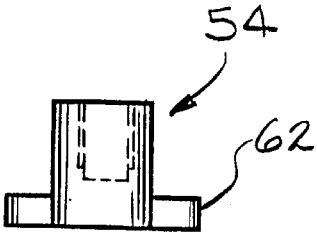
Figure 21:
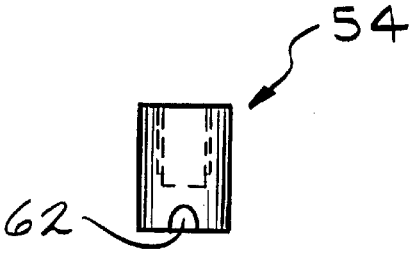

Referring to FIGS. 14 to 27, there is illustrated at 90 yet another embodiment of the pliers which is similar to the embodiment of FIGS. 2 to 9, except as described hereinafter or otherwise shown in the drawings. As seen in FIGS. 22 and 23, the screwhead 52 has a hex-aperture 92 or other suitable means for receiving a wrench for connecting the screwhead to and disconnecting the screwhead from the T-bolt 54.

Figure 27:
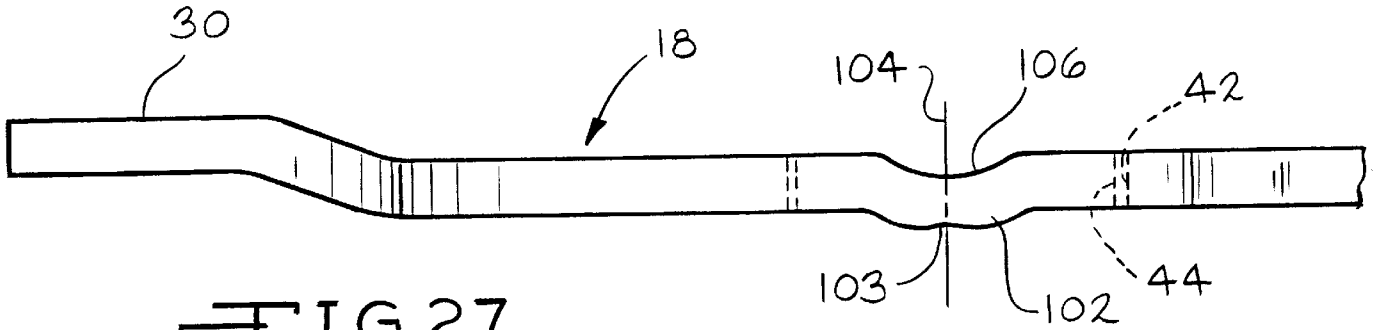
FIG. 27 is an enlarged partial side view of the lever of FIG. 16.

FIGS. 26 and 27 show the apertures 42 and 44 to be offset relative to a longitudinal centerline, illustrated at 94, of the tip 30, i.e., a line, illustrated at 96, passing through the centers of apertures 42 and 44 forms an angle, illustrated at 98, with a line, illustrated at 100, which is perpendicular to centerline 94. This angle may, for example, be perhaps about 2°32'.

Instead of formations 64, the lever 18 is formed to have a raised portion 102 over its width in which is contained groove 103. The centerline, illustrated at 104, of groove 103 is coincident with centerline 96. The lever 18 is also formed so that the opposite surface is indented, as illustrated at 106, to be parallel to the surface (without the groove 103) of the raised portion 102 so that a tighter fit may be achieved between the levers 16 and 18.

It should be understood that the invention can be embodied otherwise than as described herein without departing from the principles thereof, and such other embodiments are meant to come within the scope of the present invention as defined by the appended claims.

What is claimed is:

1. A tool comprising a pair of levers, a pivot assembly for pivotally connecting said levers, and means for converting the tool between at least two positions of said levers relative to each other, said converting means comprising an aperture means in one of said levers for each of said positions and means for inserting the pivot assembly in and removing the pivot assembly from each of said aperture means, the other of said levers having an aperture for nonremovably receiving said pivot assembly, said pivot assembly being rotatably mounted within said aperture and having a knob thereon for rotating said pivot assembly for releasably engaging the pivot assembly with said aperture means.

2. A tool according to claim 1 wherein said pivot assembly includes a member having a body and an elongate portion which is perpendicular to an axis of said body, and wherein each of said aperture means comprises a central portion for receiving said body and an elongate portion for receiving said elongate portion of said member for removing and inserting said pivot assembly in said respective aperture means, and the tool further comprising means for lockingly positioning said pivot assembly member so that said elongate portion of said member is oriented at an angle relative to said elongate portion of said aperture means so that said pivot assembly is retained in said respective aperture means.

3. A tool according to claim 2 wherein said aperture in the other of said levers which is shaped to prevent passage of said elongate portion of said pivot assembly member for thereby non-removably receiving said pivot assembly.

4. A tool comprising a pair of levers each having a handle portion and a jaw portion, a pivot assembly comprising a member having a body and an elongate portion which is perpendicular to an axis of said body and a knob for rotatably moving said pivot assembly, said pivot assembly for pivotally connecting said levers so that movement of said handle portions relative to each other effects opening and closing of said jaw portions, and means for converting the tool between first and second types for opening and closing respectively said jaw portions upon movement of said handle portions toward each other, said converting means comprising first and second aperture means in one of said levers for said first and second types respectively and means for inserting the pivot assembly in and removing the pivot assembly from each of said aperture means.

5. A tool according to claim 4 further comprising an aperture means in another of said levers for non-removably receiving said pivot assembly.

6. A tool according to claim 4 wherein each of said aperture means comprises a central portion for receiving said body and an elongate portion for receiving said elongate portion of said member for removing and inserting said pivot assembly in said respective aperture means, and the tool further comprising means for lockingly positioning said pivot assembly member so that said elongate portion of said member is oriented at an angle relative to said elongate portion of said aperture means so that said pivot assembly is retained in said respective aperture means.

7. A tool according to claim 6 further comprising an aperture means in another of said levers which is shaped to prevent passage of said elongate portion of said pivot assembly member for thereby non-removable receiving said pivot assembly.

8. A tool comprising a pair of levers, a pivot assembly for pivotally connecting said levers, and means for converting the tool between at least two positions of said levers relative to each other, said converting means comprising an aperture means in one of said levers for each of said positions and means for inserting the pivot assembly in and removing the pivot assembly from each of said aperture means; and said pivot assembly includes a member having a body and an elongate portion which is perpendicular to an axis of said body, and wherein each of said aperture means comprises a central portion for receiving said body and an elongate portion for receiving said elongate portion of said member for removing and inserting said pivot assembly in said respective aperture means, and the tool further comprising means for lockingly positioning said pivot assembly member so that said elongate portion of said member is oriented at an angle relative to said elongate portion of said aperture means so that said pivot assembly is retained in said respective aperture means; and wherein said lockingly positioning means comprises means on said one lever defining a ramp having groove means for receiving said elongate portion of said pivot assembly member and spring means for holding said elongate portion of said pivot assembly member tightly in said groove means.

9. A tool comprising a pair of levers each having a handle portion and a jaw portion, a pivot assembly for pivotally connecting said levers so that movement of said handle portions relative to each other effects opening and closing of said jaw portions, and means for converting the tool between first and second types for opening and closing respectively said jaw portions upon movement of said handle portions toward each other, said converting means comprising first and second aperture means in one of said levers for said first and second types respectively and means for inserting the pivot assembly in and removing the pivot assembly from each of said aperture means; and said pivot assembly includes a member having a body and an elongate portion which is perpendicular to an axis of said body, and wherein each of said aperture means comprises a central portion for receiving said body and an elongate portion for receiving said elongate portion of said member for removing and inserting said pivot assembly in said respective aperture means, and the tool further comprising means for lockingly positioning said pivot assembly member so that said elongate portion of said member is oriented at an angle relative to said elongate portion of said aperture means so that said pivot assembly is retained in said respective aperture means; and said lockingly positioning means comprises means on said one lever defining a ramp having groove means for receiving said elongate portion of said pivot assembly member and spring means for holding said elongate portion of said pivot assembly member tightly in said groove means.

10. A tool comprising a pair of levers, a pivot assembly for pivotally connecting said levers, and means for converting the tool between at least two positions of said levers relative to each other, said converting means comprising an aperture means in one of said levers for each of said positions and means for inserting the pivot assembly in and removing the pivot assembly from each of said aperture means, the other of said levers having an aperture for nonremovably receiving said pivot assembly, said pivot assembly being rotatably mounted within said aperture and having a knob thereon for rotating said pivot assembly for releasably engaging the pivot assembly with said aperture means, and said pivot assembly further comprising a spring means for releasably holding said pivot assembly in said aperture means.

* * * * *